US007568930B2

(12) United States Patent
Brand et al.

(10) Patent No.: US 7,568,930 B2
(45) Date of Patent: Aug. 4, 2009

(54) FLOURESCENT LAMP SOCKET WITH ENHANCED CONTACT RELIABILITY

(75) Inventors: Andreas Brand, Ludenscheid (DE); Ulf Selve, Ludenscheid (DE)

(73) Assignee: Vossloh-Schwabe Deutschland GmbH, Ludenscheid (DE)

( * ) Notice: Subject to any disclaimer, the term of this patent is extended or adjusted under 35 U.S.C. 154(b) by 0 days.

(21) Appl. No.: 11/985,608

(22) Filed: Nov. 19, 2007

(65) Prior Publication Data

US 2009/0068869 A1 Mar. 12, 2009

(30) Foreign Application Priority Data

Sep. 11, 2007 (DE) ..... 10 2007 043 266

(51) Int. Cl.
*H01R 33/02* (2006.01)

(52) U.S. Cl. ..... 439/234; 439/241

(58) Field of Classification Search ..... 439/234, 439/239–241

See application file for complete search history.

(56) References Cited

U.S. PATENT DOCUMENTS 2,233,931 A * 3/1941 Alden ..... 439/241
2,238,151 A * 4/1941 Alden ..... 439/241
2,238,152 A * 4/1941 Alden ..... 439/241
5,816,837 A * 10/1998 Henrici et al. ..... 439/231

FOREIGN PATENT DOCUMENTS

DE 1 008 826 A 8/1953
DE 1 006 974 A 10/1954
EP 1251603 A2 10/2002

OTHER PUBLICATIONS

German Patent and Trademark Office; Official Action; May 26, 2008.

* cited by examiner

*Primary Examiner*—Khiem Nguyen
(74) *Attorney, Agent, or Firm*—Emch, Schaffer, Schaub & Porcello Co., L.P.A.

(57) ABSTRACT

The lamp socket according to the invention demonstrates a housing (2) with a rotor (26). Contacts (15, 16), which demonstrate contact tags (17) that are resilient in the swivel direction, are mounted in the housing (2). The open ends (18) of the contact tags can support themselves on stopping means (31 to 34), which are moved by the rotor (26). In the support position, they are positioned on the ends (18) of the contacts (15, 16). When the lamp is rotated from its insertion position into its connected position, the support means (31 to 34) are distant from the ends (18) of the contacts (15, 16), however, so that the lamp can be rotated relatively freely without current. Only near the end of this rotational movement do cams provided on the support means (31 to 34) bump against the ends (18) of the contacts (15, 16) and force them radially inwards and clamp the contacts (15, 16) against the pins (45, 46) of the lamp.

18 Claims, 6 Drawing Sheets

FLOURESCENT LAMP SOCKET WITH ENHANCED CONTACT RELIABILITY

BACKGROUND OF THE INVENTION

The invention relates to a socket for lamps, especially electric discharge lamps, preferably fluorescent lamps.

SUMMARY OF THE INVENTION

Fluorescent lamps often consist of a straight discharge tube which is provided with a socket at both ends. Each socket carries two pins, which serve for mechanical mounting of the fluorescent lamp and for the electrical supply of same. Various lamp sockets for such fluorescent lamps are in use. One example for this can be found in EP 1 251 603 A2. The lamp socket illustrated therein demonstrates a housing made of insulating material into which a rotor, likewise consisting of insulating material, is inserted. The rotor can rotate around an axis that is coaxial to the lamp tube of the fluorescent lamp accommodated by the socket. The rotor is provided with an insertion slot, into which the pins of the fluorescent lamp can be inserted in the radial direction. Springy contact sheets, which come into contact with the pins of fluorescent lamp when the pins are inserted into the rotor and the lamp is rotated around its longitudinal axis by 90°, are located on both flanks of the rotor.

The contact springs must develop a sufficient compression force to enable reliable current transfer. This assumes that the contact springs are configured in a fairly stiff manner. The forces required to rotate the fluorescent lamp are correspondingly large, a fact that can result in the lamp not being rotated into its correct contact position of, for example, a 90° twist relative to the insertion position, during the installation. Such a case can lead to diminished contact forces, and consequently to increased transition resistances and ultimately to impermissible heating.

It is the object of the invention to create a lamp socket with enhanced reliability.

This object is achieved by the lamp socket according to claim 1:

The lamp socket according to the invention demonstrates a housing made of insulating material and at least one contact mounted in the housing and a rotor, which is rotatably mounted and consists of insulating material. A support means for the rotor is disposed on the rotor. While the contact is held in the housing, the support means rotates along with the rotor. It therefore moves relative to the housing and to the contact. This circumstance can be utilized to allow the support of the contact to become effective only when the lamp has been rotated into connected position. When the lamp is not in its connected position but in its insertion position, the support means can be ineffective. In other words, the support means can be used to press the contact onto the pin of the lamp when the lamp is rotated into contact position. This makes it possible to create a lamp socket that achieves a high contact force with relatively flexible contacts. Due to the high contact force, a lower electrical transition resistance arises between the contact and the pin of the lamp. The danger of heating or overheating the contact is excluded.

The contact of the lamp socket is preferably formed by a springy contact sheet. This can demonstrate an end that is preferably bent arc-shaped or is angled and that is arranged to fit into place on the support means. The support means helps to force the contact against the pin of the lamp. To this end, the support means preferably forces the contact radially inwards relative to the rotor.

It is advantageous if the lamp socket is provided with a pin support device, which can be disposed between the pins of the lamp for example. This makes it possible to let relatively large compression forces act between the contact and the pin of the lamp without overloading the pin of the lamp.

It is furthermore advantageous if a stopping means is provided opposite the support means. The stopping means can, for example, be a projection, which is provided on the rotor and which defines a slot or passage in combination with the support means. Whereas the support means is configured as an arc-shaped rib, for example, a triangular nose or the like can form the stopping means. The stopping means can be used to keep the contact from being too far radially inwards when the rotor is in the lamp insertion position. Finally, a rotor is thereby created which actively moves the contact from a radially further outward position when the rotor is in the lamp insert position to a radially further inward position when the rotor is in connected position.

Additional details of advantageous embodiments of the invention are subject matter of claims, the drawing or the description. The description is limited to essential aspects of the invention and other actualities. The drawing discloses further details and is to be used as a supplementary means of interpretation. The drawing illustrates an example embodiment of the invention. The drawing shows:

DETAILED DESCRIPTION OF THE INVENTION

Figures 1, 1A, 1B:
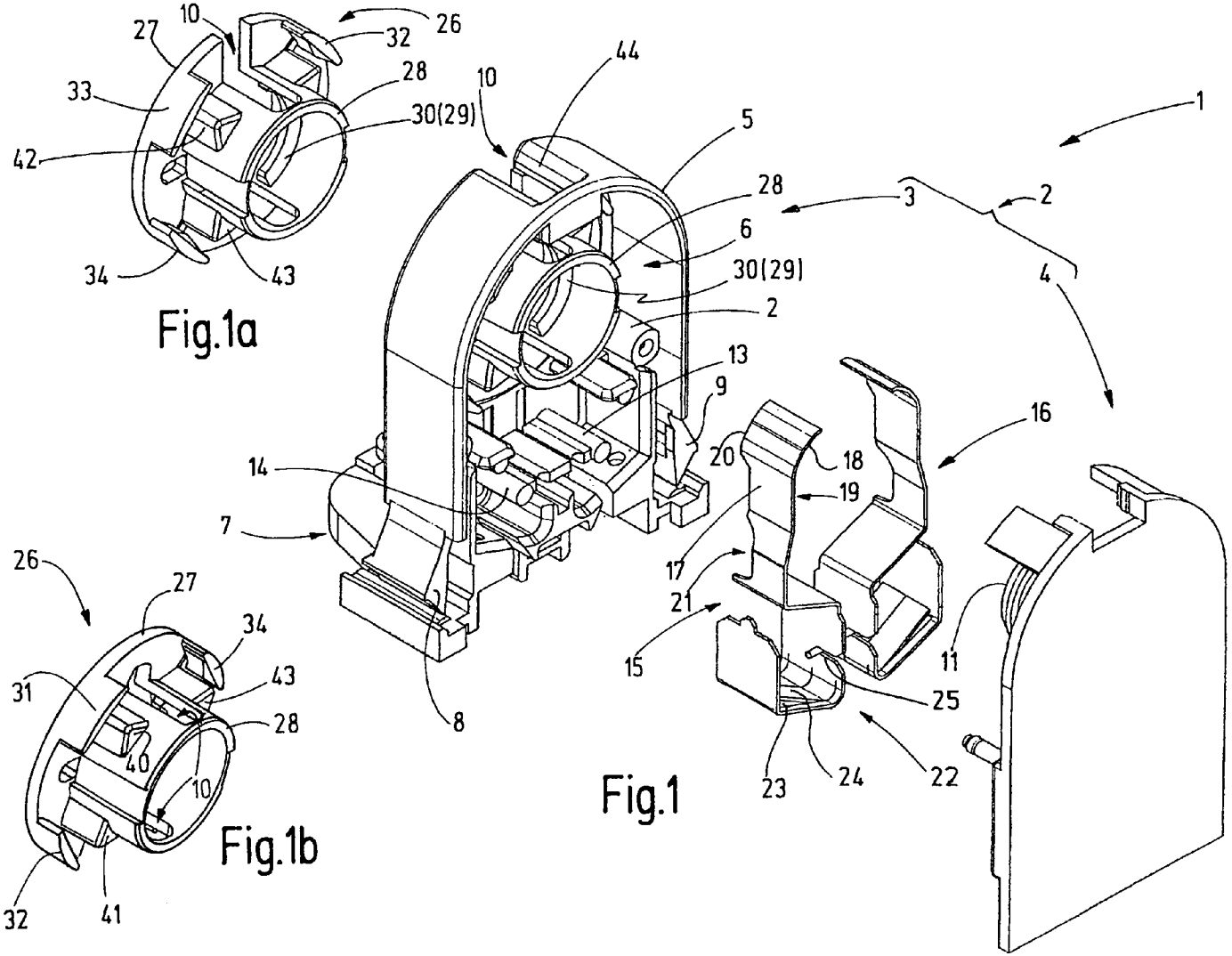
FIG. 1 the lamp socket in exploded view.
FIG. 1*a* the rotor of the socket as per FIG. 1 in separate perspective view, FIG. 1*b* the rotor of the socket as per FIG. 1 in separate perspective view, rotated by 180°, FIG. 2 the lamp socket in vertical sectioned view with the rotor in the insertion position, and FIGS. 3-5 the lamp socket as per FIG. 2 in vertical sectioned view in various intermediate positions, and FIG. 6 the lamp socket in vertical sectioned view with the rotor in the connected position.

The lamp socket 1 illustrated in FIG. 1 demonstrates a housing 2, which is made of insulating material and can comprise of two housing parts 3, 4 for example. The housing parts 3, 4 consist of an insulating material, such as an injection moldable plastic. Whereas the housing part 4 forms a basically flat back wall, a plurality of projections projecting from its flat side, housing part 3 is provided with a U-shaped rim 5, which projects from a front side and defines an interior space 6. One or more feet 7, which serve to fasten the lamp socket 1 to a trunking or other carrier, are provided on one end of housing part 3, it also being possible to provide latches 8, 9.

The housing part 3 is provided with an insertion slot 10, which passes through the rim 5 and the front side of the housing part 3. To this end, the insertion slot 10 also crosses a pipe-socket-like catch 11, which projects from the front side of the housing part 4 into its interior space 6. Additional extensions 12, 13, 14 extend from the front wall of housing part 3 into the interior space 6 to form mountings for the housing part 4 and contacts 15, 16, which are to be mounted in the interior space 6. The contacts 15, 16 are configured as mirror images of one another. The following description of contact 15 thus applies to contact 16 in corresponding mirror-image form.

Contact 15 demonstrates a contact tag 17, which acts as a leaf spring. It demonstrates an arc-shaped, or in a plurality of facets, bent end section 18, which is bent around the catch 11. One edge 19 faces housing part 4, i.e. the back wall of the housing 2. This edge 19 is configured straight. The edge 20, which is located opposite and faces the front wall, in contrast, is provided with a cutout 21, which is disposed at a distance to the end section 18.

In the connection to the cutout 21, the contact tag 17 transitions into a mounting and connecting section 22. In the present example embodiment, this is bent as a rectangular hook and serves to fix the contact 15 within the interior space 6 of the housing part 3. To this end, the housing part 3 demonstrates, in its interior space 6, appropriate mounting structures into which the contact 15 can be pushed.

For electrical contacting, the underside of contact 15 demonstrates, for example, one or more openings 23 to which a feed 24 that has been released can be assigned. The feed 24 and the opening 23 can form a plug-in contact. By way of substitution, other connecting means can be provided.

In addition, a contact slot 25 can be provided on the mounting and connecting section 22 in order to establish an electrical bridge to the contact 16, for example. Alternatively the two contacts 15,16 can be manufactured out of one piece of sheet and thus be connected by a web, which can be ripped out if necessary.

To the socket 1 there belongs a rotor 26, which demonstrates a front disk-shaped section 27 and a tube extension 28, which extends away from the section 27. It engages the catch 11 and is locked to it. The insertion slot 10 transversely cuts the rotor 26 and the tube extension 18, severing the rim of the disk-shaped front side of the rotor 26 only on one side. Provided on the inner wall of tube extension 28 are ribs 29, 30, which are particularly obvious in FIG. 2, run in the peripheral direction, serve for mounting the rotor 26 within the housing 2 and are locked to the catch 11 when the housing 2 is assembled. To this end, the catch can be provided with a toothing or with ribs.

Figure 2:
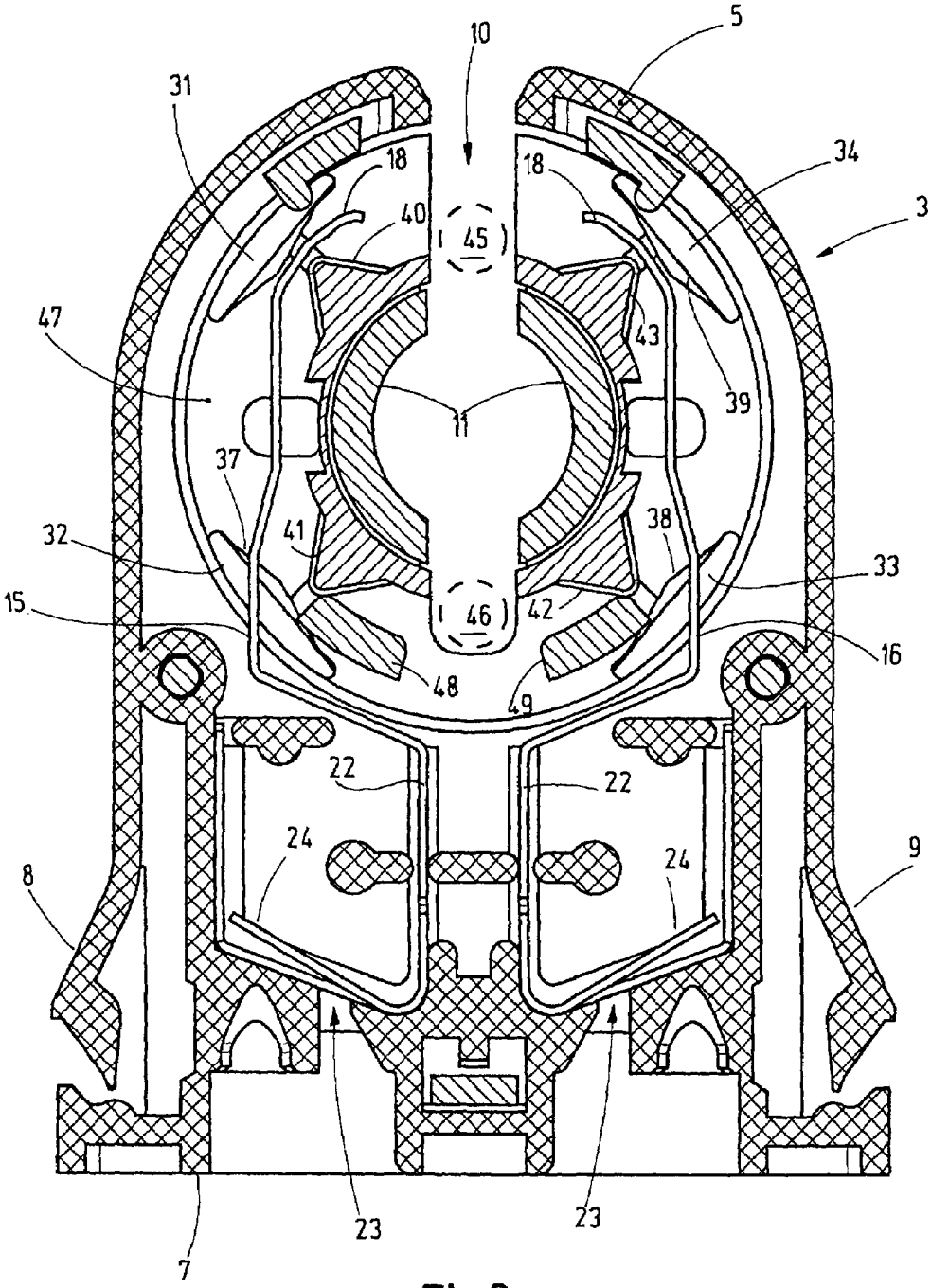

Provided on the rotor 26 are several, preferably four, support means 31 to 34, which are spaced from each other at 90° angles and, as particularly evident from FIGS. 1*a* and 2, are preferably configured as arc-shaped ribs, which are disposed in the neighborhood of the external perimeter of the disk-shaped section 27 and extend into the interior space 6. The inside of the support means 31 to 34 can be provided with noses 36, 37, 38, 39, which project toward the center of rotation 35 of the rotor and form cams to actuate the contacts 15, 16.

Located opposite the support means 31 to 34, there are provided several, preferably four, stopping means 40, 41, 42, 43, which can be configured in the form of triangular noses projecting outwards from the tube extension 28 in the radial direction, for example, and which are located further inwards radially, i.e. closer to the center of rotation 35. Together with the support means 31 to 34, the stopping means 40 to 43 each form a slot-like passage. As evident from FIG. 2, the end sections 18 of the two contacts 15, 16 preferably each extend through such a slot-like passage.

The lamp socket 1 described so far operates as follows:

As depicted in FIG. 2, the rotor 26 is situated in a lamp insertion position in such a manner that the insertion slot 10 aligns with its inlet 44 configured on the rim 5 of housing part 3. The contacts 15, 16, which are bent slightly inwards, i.e. toward center of rotation 35, especially in the vicinity of their contact tags 17, are freely relaxed and their ends 18 respectively extend through the slot between the support means 31 and the stopping means 40 or the slot between support means 34 and the stopping means 43. It is now possible to insert a lamp into lamp socket 1 by pushing its pins (at least one of which is a contact pin) into the insertion slot 10. In FIG. 2, the pins 45, 46 are only indicated by dashes.

Figure 3:
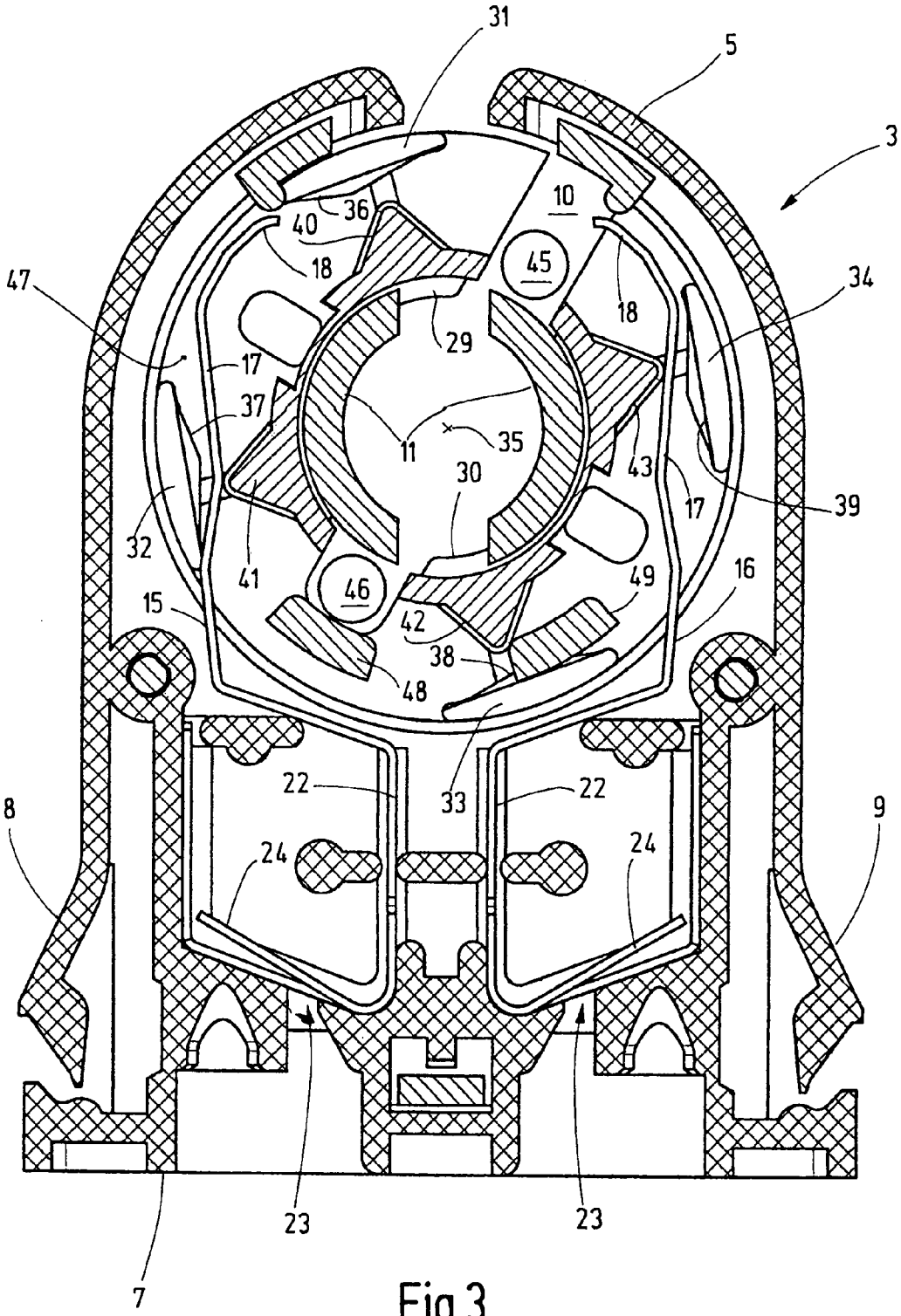
Figure 4:
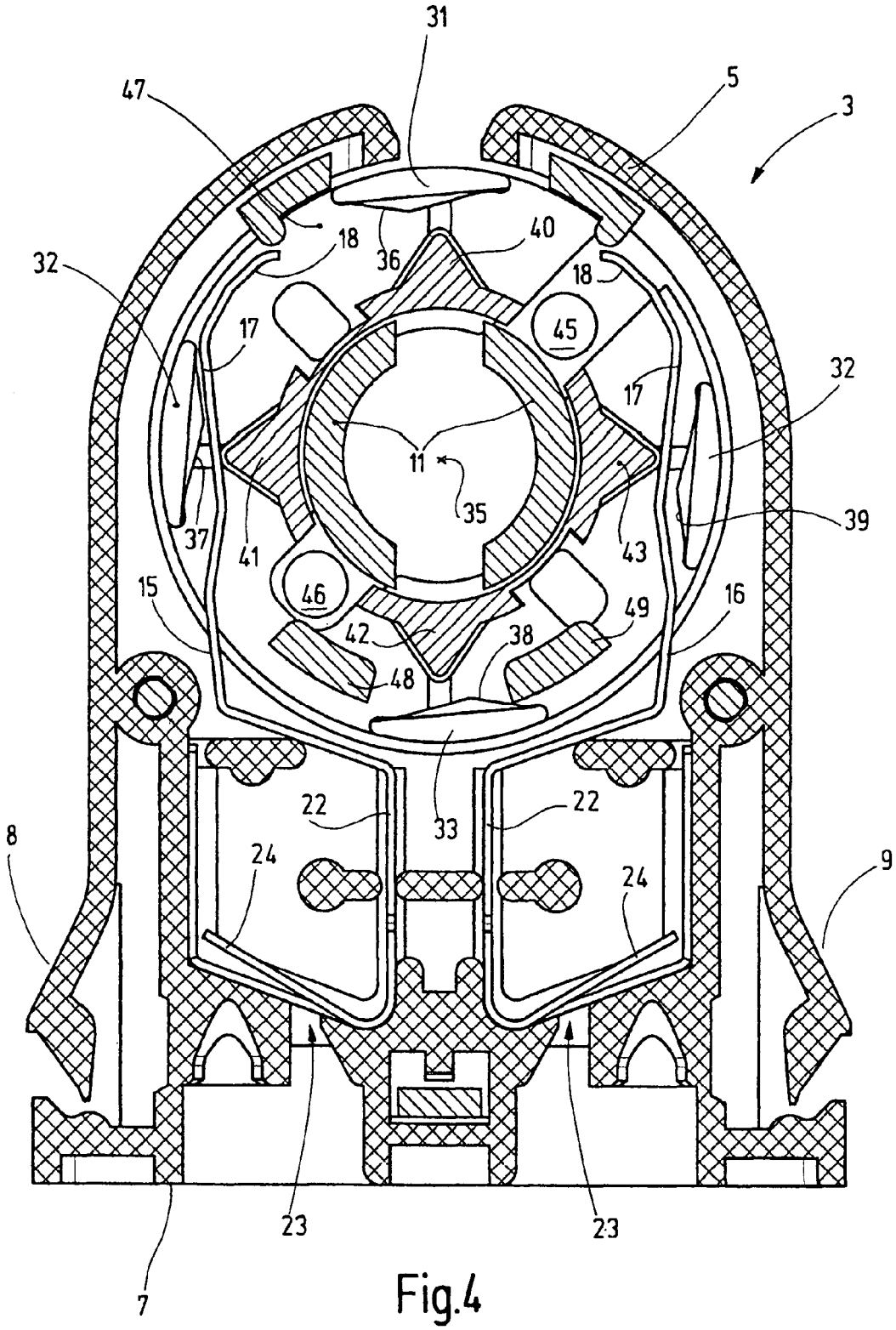
Figure 5:
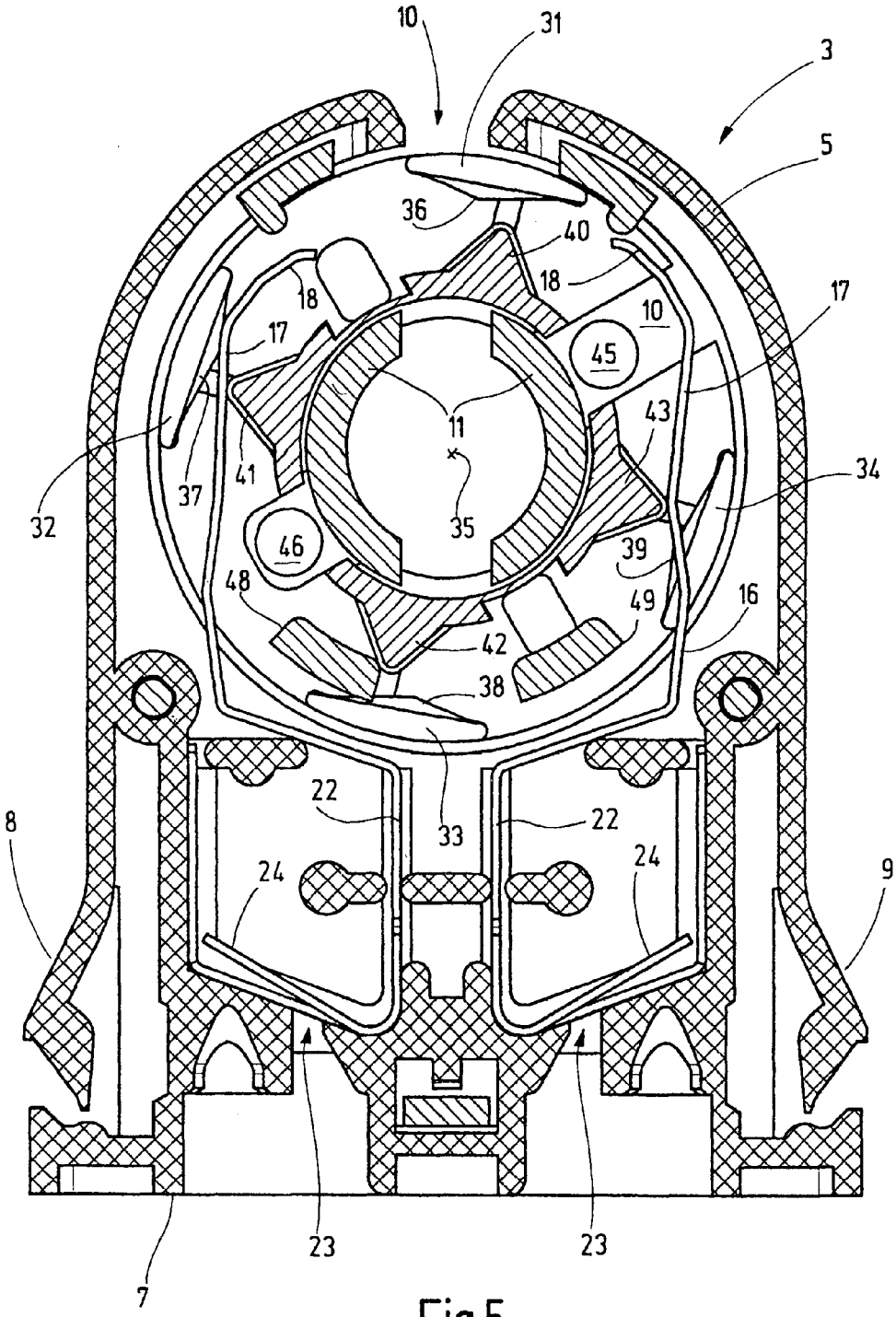
Figure 6:
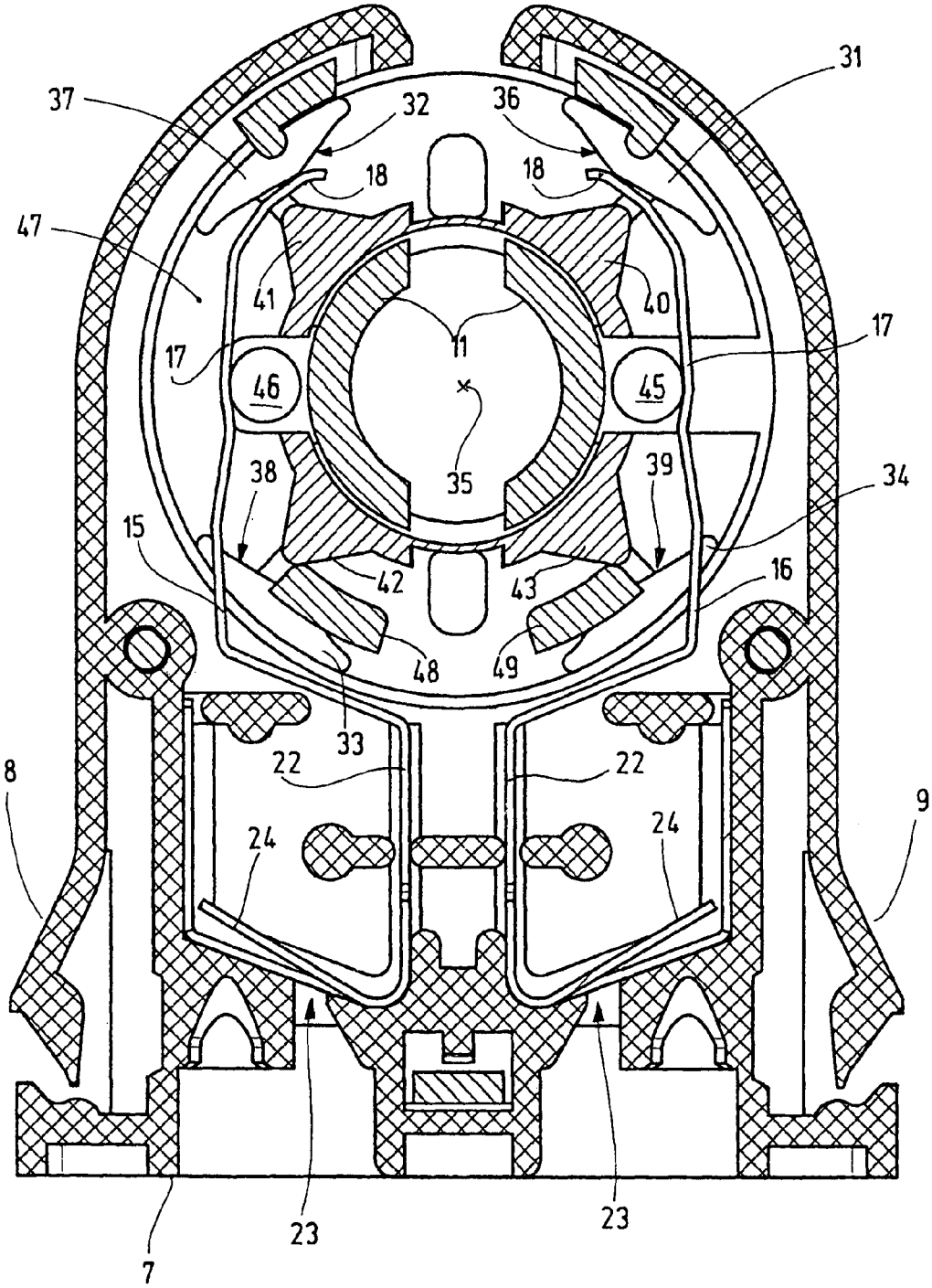

Rotating the lamp 90° around the center of rotation 35, takes the pins 45, 46 out of the position depicted FIG. 2 (lamp insertion position) and brings them into the position depicted in FIG. 6 (connected position). FIG. 2 depicts the rotor at 0°, FIG. 3 at 30°, FIG. 4 at 45°, FIG. 5 at 60° and FIG. 6 at 90°. As evident, the contact tags 17 can be forced outwards by the stopping means 41, 43 during the rotation of the rotor 26 into the phases of rotation as per FIGS. 3 to 5 and thereby freely spread radially outwards.

During the 90° rotation, the stopping means 42 must first pass the projection 49 and then the projection 48, which are provided on the housing part 4 and each of which expands in the radial direction. This requires a certain torque. This provides a rotate/lock effect, which facilitates the operation.

As long as the rotor 26 has not traveled its 60° rotational position, the support means 33, 34, will pass through the cutouts 21 of the contacts 15, 16, as depicted in FIGS. 2 to 5, and remain inactive.

If the rotor 26 has traveled its 60° position, the support means 31, 32 bump against the ends 18 of the contacts 15, 16 and force them inwards with their noses 36, 37. The contact tags 17 are thereby clamped against the pins 45, 46 and a high contact pressure is generated.

As evident, the contacts 15, 16 are each supported on two ends when in the contact state as per FIG. 6, namely on their open end 18 and on their mounting and connecting section 22. This is the case when the rotor 26 is rotated into the connected position, i.e. when the insertion slot 10 is twisted by approximately 90° relative to the inlet 44. In this respect, the twisting is relative to the center of rotation 35.

When the rotor 26 is situated in the lamp insertion position as per FIG. 2, however, the contacts 15,16 are each seized only on one end, namely on the respective mounting and connecting section 22. The end 18 can freely move to some degree in the play of the respective clearance zone between the nose 36, 39 and the stopping means 40, 43.

In the transition between the insertion position as per FIG. 2 and the connected position as per FIG. 6, the contacts 15, 16 are likewise held only on one end, namely the on the mounting and connecting section 22, whereas the other ends 18 can freely swivel radially outwards. In this state, there are no stopping means located opposite the ends 18.

The lamp socket according to the invention demonstrates a housing 2 with a rotor 26. Contacts 15, 16, which demonstrate contact tags 17 that are resilient in the swivel direction, are mounted in the housing 2. The open ends 18 of the contact tags can support themselves on stopping means 31 to 34, which are moved by the rotor 26. In the support position, they are positioned on the ends 18 of the contacts 15, 16. When the lamp is rotated from its insertion position into its connected position, the support means 31 to 34 are distant from the ends 18 of the contacts 15, 16, however, so that the lamp can be rotated relatively freely without current. Only near the end of this rotational movement do cams provided on the support means 31 to 34 bump against the ends 18 of the contacts 15, 16 and force them radially inwards and clamp the contacts 15,16 against the pins 45, 46 of the lamp.

| Reference characters | |
|---|---|
| 1 | lamp socket |
| 2 | housing |
| 3, 4 | housing parts |

-continued

| Reference characters | |
|---|---|
| 5 | rim |
| 6 | interior space |
| 7 | foot |
| 8, 9 | latching means |
| 10 | insertion slot |
| 11 | catch |
| 12, 13, 14 | extensions |
| 15, 16 | contacts |
| 17 | contact tag |
| 18 | end section |
| 19, 20 | edge |
| 21 | cutout |
| 22 | mounting and connecting section |
| 23 | opening |
| 24 | feed |
| 25 | contact slot |
| 26 | rotor |
| 27 | section |
| 28 | tube extension |
| 29, 30 | ribs |
| 31-34 | support means |
| 35 | center of rotation |
| 36-39 | noses |
| 40-43 | stopping means |
| 44 | inlet |
| 45, 46 | pins |
| 47 | location |
| 48, 49 | projections |

We claim:

1. Lamp socket (1) for a lamp having at least two pins (45, 46), comprising a housing (2), which includes an insulating material, at least once contact (15), which is disposed in the housing (2), and a rotatably mounted rotor (26), which includes an insulating material and demonstrates at least one support means (31) for the contact (15), said housing having a pin support device between the pins (45, 46) of the lamp and characterized in that a catch (11), which proceeds from a housing part (4) and extends into a tube extension (28) of the rotor and secures the rotor (26) on the housing (2), forms the pin support device.

2. Lamp socket according to claim 1, characterized in that the support means (31) is arranged to force the contact (15) against a pin (45, 46) of the lamp.

3. Lamp socket according to claim 1, characterized in that the rotation of the rotor (26) moves the contact (15) radially inwards when the rotor (26) is rotated into a position in which its insertion slot (10) is situated crosswise to a lamp insertion position.

4. Lamp socket according to claim 1, characterized in that a rib, which is to be brought into contact with an external side of the contact and is configured on the rotor (26), forms the support means (31).

5. Lamp socket according to claim 1, characterized in that a stopping means (40) is disposed opposite the support means (31).

6. Lamp socket (1) for a lamp having at least two pins (45, 46), comprising a housing (2), which comprises an insulating material, at least one contact (15), which is disposed in the housing (2), and a rotatably mounted rotor (26), which comprises an insulating material and demonstrates at least one support means (31) for the contact (15), characterized in that a rib, which is to be brought into contact with an external side of the contact and is configured on the rotor (26), forms the support means (31), and further characterized in that an intermediate space, through which a section of the contact (15) extends, is configured between the stopping means (40) and the support means (31).

7. Lamp socket according to claim 5, characterized in that a projection provided on the rotor (26) forms the stopping means (40).

8. Lamp socket according to claim 1, characterized in that the contact (15) demonstrates a cutout (21) at a location spaced from its end (18) in order to ensure passage for the support means (31) when the rotor (26) rotates.

9. A lamp socket for receiving a lamp having a pair of pins (45, 46) for receiving electricity comprising (a) a housing (2) defining an interior space (6) and having an inlet (44) opening to said interior;

(b) a pair of spaced apart resilient contacts (15, 16) positioned in said space (6), each said contact extending from a first mounting end (22) mounted on said housing to a free end (18) and having a contact tag (17) between said first mounting end (22) for engagement by one of said pins, said free end (18) and said contact tag (17) being movable upon urging by another member; and (c) a rotor (26) having a disk-shaped section (27) and a tube extension (28) defining an axis extending into said interior space, said rotor (26) having insertion slot (10), a plurality of support members (31-34) extending axially from said disk-shaped section (27) and spaced radially outwardly from said tube extension (28), each of said contacts (15) positioned to have each said free end (18) engaged by one of said support members (31-34) to urge said free ends (18) closer to one another as said rotor approaches and reaches the 90° position and to urge each said contact tag (17) into engagement with a pin aligned therewith.

10. A lamp socket according to claim 9 wherein said contacts (15, 16) have cutouts between said first mounting end (22) and said contact tag (17) to ensure passage for the support members (31-34) when the rotor (26) rotates.

11. A lamp socket according to claim 9, characterized in that the ends (18) of said contacts are bent arc-shaped.

12. A lamp socket according to claim 9, characterized in that a rib, which is to be brought into contact with an external side of the contact and is configured on the rotor (26), forms the support member (31).

13. A lamp socket according to claim 9, characterized in that a stopping means (40) is disposed opposite the support member (31).

14. A lamp socket according to claim 12, characterized in that an intermediate space, through which a section of the contact (15) extends, is configured between the stopping means (40) and the support member (31).

15. A lamp socket according to claim 9, further characterized in that there is provided one or more stop members (40-43) extending outwardly from said tube extensions (28) and disposed opposite the support member (31).

16. A lamp socket according to claim 15, further characterized in that each of said contacts (15) is positioned to have their respective contact tags (17) engaged by a stop member during a portion of rotational movement of said rotor (28) from a position for receiving pins of a lamp when said insertion slot (10) is aligned with said inlet (44), toward a position 90° therefrom and are out of engagement with said stop member when at said 90° position.

17. A lamp socket according to claim 9, characterized in that a projection provided on the rotor (26) forms the stop member (40).

18. A lamp socket for receiving a lamp having a pair of pins (45, 46) for receiving electricity comprising (a) a housing (2) defining an interior space (6) and having an inlet (44) opening to said interior;

(b) a pair of spaced apart resilient contacts (15, 16) positioned in said space (6), each said contact extending from a first mounting end (22) mounted on said housing to a free end (18) and having a contact tag (17) between said first mounting end (22) for engagement by one of said pins, said free end (18) and said contact tag (17) being movable upon urging by another member; and (c) a rotor (26) having a disk-shaped section (27) and a tube extension (28) defining an axis extending into said interior space, a plurality of spaced apart stop members (40-43) extending outwardly therefrom, said rotor (26) having an insertion slot (10), a plurality of support members (31-34) extending axially from said disk-shaped section (27) and spaced radially outwardly from said tube extension (28) and said stop members (40-43) and each positioned opposite one of said stop members, each of said contacts (15) positioned (A) to have their respective contact tags (17) engaged by a stop member during a portion of rotational movement of said rotor (28) from a position for receiving pins of a lamp when said insertion slot (10) is aligned with said inlet (44) toward a position 90° therefrom and are out of engagement with a stop members when at said 90° position and (B) to have each said free end (18) engaged by one of said support members (31-34) to urge said free ends (18) closer to one another as said rotor approaches and reaches said 90° position and to urge each said contact tag (17) into engagement with a pin aligned therewith.

* * * * *